US005226841A

United States Patent [19]

Thörner

[11] Patent Number: 5,226,841

[45] Date of Patent: Jul. 13, 1993

[54] CLAMPING DEVICE FOR MAKING AN ELECTRICAL CONNECTION

[76] Inventor: Wolfgang B. Thörner, Hatzper Strasse 125, D-4300 Essen 1, Fed. Rep. of Germany

[21] Appl. No.: 752,652

[22] PCT Filed: Nov. 26, 1990

[86] PCT No.: PCT/EP90/02017

§ 371 Date: Aug. 22, 1991

§ 102(e) Date: Aug. 22, 1991

[87] PCT Pub. No.: WO91/10270

PCT Pub. Date: Jul. 11, 1991

[30] Foreign Application Priority Data

Dec. 23, 1989 [DE] Fed. Rep. of Germany ..... 8915171
Feb. 21, 1990 [DE] Fed. Rep. of Germany ..... 9002036

[51] Int. Cl.[5] ..... H01R 4/38

[52] U.S. Cl. ..... 439/801; 439/812

[58] Field of Search ..... 439/801-814, 439/779, 789

[56] References Cited

FOREIGN PATENT DOCUMENTS 28258 8/1921 Denmark ..... 439/813
1130493 5/1962 Fed. Rep. of Germany ..... 439/779

*Primary Examiner*—Eugene F. Desmond
*Attorney, Agent, or Firm*—Collard & Roe

[57] ABSTRACT

A clamping device for making an electrical connection has a tightening nut which can be screwed on a screw thread and on being axially adjusted exerts a clamping force on a component which cannot be axially moved, e.g., the end of a cable to be clamped. In order to permit particularly easy tightening and releasing in such a clamping device and prevent damage to the axially immovable component, the tightening nut is fitted on the clamping side with a separate pressure member transmitting the clamping force fitted on the clamping nut rotatably about the screw thread axis.

11 Claims, 4 Drawing Sheets

CLAMPING DEVICE FOR MAKING AN ELECTRICAL CONNECTION

Figure 1:
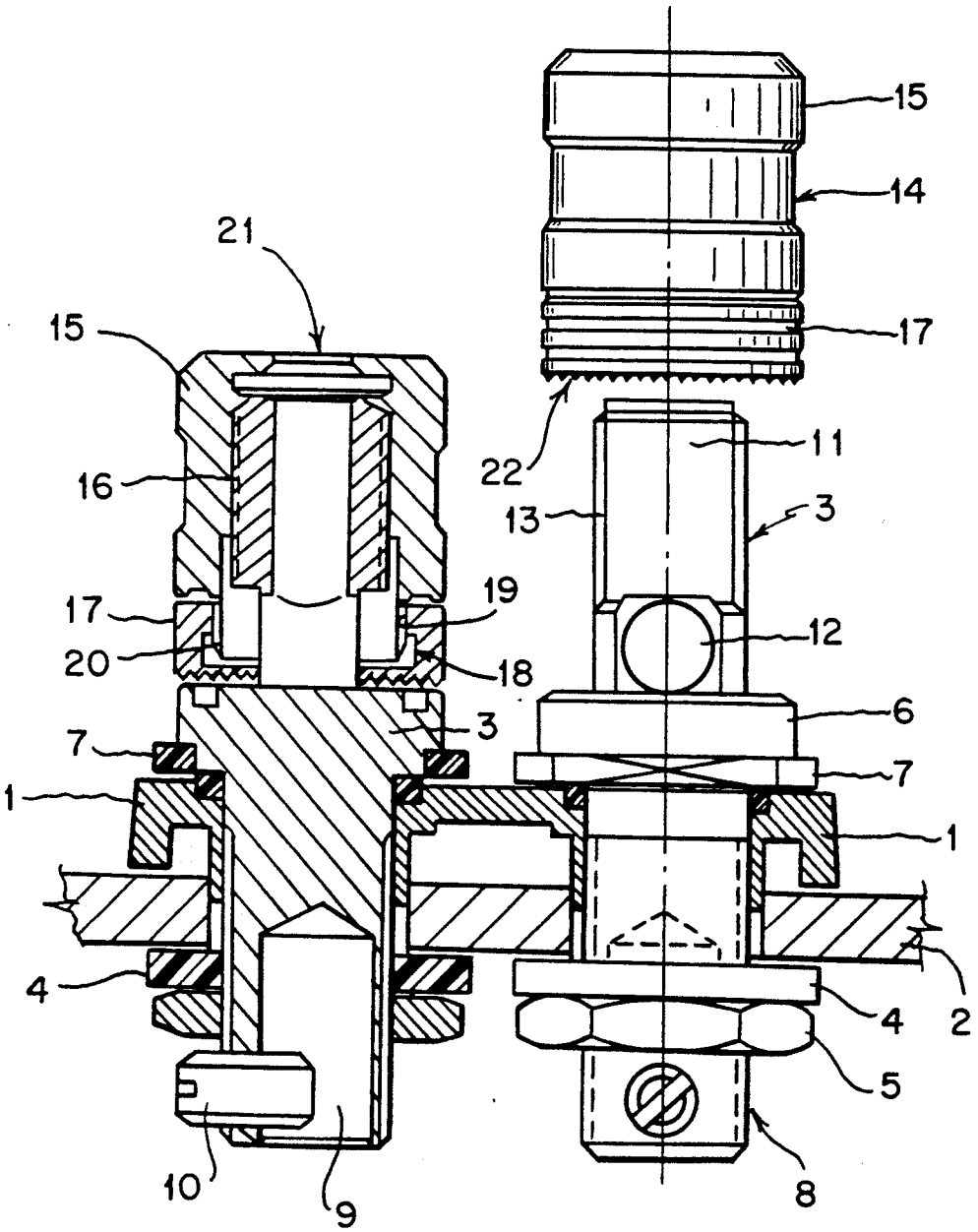

The invention relates to a clamping device for making an electrical connection, with a tightening nut which can be screwed onto a screw thread of the clamping device and, when adjusted in an axial direction, exerts a clamping force on a part which cannot be moved in the axial direction.

Such clamping devices are used, for example, in so-called pole clips for coupling lines to equipment in the category of entertainment electronics. They are characterized by the fact that connecting and disconnecting the leads can easily be carried out by hand. However, clamping devices of the type stated are also used in so-called cinch (RCA) plugs, in which the cover sleeve which can be axially screwed onto the plug element exerts axially and radially directed clamping forces on an outer ring contact of the cinch (RCA) plug, which is conical on the outside and provided with axial longitudinal slits, with one end (cf. DE-GM 84 36 689. The radially directed clamping forces produced in this way result in a particularly secure hold of the outer ring contact on the outer ring contact of the corresponding bushing, which hold will not come loose.

A disadvantage of the known clamping devices consists of the fact that when the clamping force is produced, a strong friction between the tightening nut and the part which cannot be moved in an axial direction occurs, directed against the rotational movement of the tightening nut. Due to this friction, scoring or other damage occurs at the part which cannot be moved axially. Furthermore, this friction hinders the rotational movement of the tightening nut and thus impairs the tightening and loosening process.

It is therefore the task of the invention to further develop the clamping device of the type stated initially, in such a way that scoring or comparable damage to the axially fixed part is avoided, and the tightening and loosening process is facilitated.

To accomplish this task, the invention proposes, based on the clamping device of the type stated initially, that the tightening nut is provided on the clamping side with a separate pressure piece which transmits the clamping force, which is mounted on the tightening nut so as to rotate around the screw thread axis.

With the pressure piece mounted to rotate around the screw axis, the friction which hinders the screwing process in the circumference direction is significantly reduced, so that the tightening and loosening process is correspondingly facilitated.

Since a relative displacement between the axially fixed part and the pressure piece no longer takes place during the tightening process, scoring and other damage to the part fixed in the axial direction is avoided.

A first embodiment of the invention provides that the clamping device is structured as a pole terminal, with a metallic conductive element, which is provided with the screw thread for the tightening nut and with a cross-bore to hold an electric lead, which can be clamped in place in the bore by means of the tightening nut, where the pressure piece is structured as a ring element, which can be moved over the opening cross-section of the cross-bore.

In advantageous manner, the ring element has a ring-shaped projection facing inward, which engages behind a ring shoulder on the tightening nut. With this sample mounting of the ring element on the basic part, the ring element is securely held and guided on the tightening nut in an axial direction, during the tightening and loosening process.

It is practical if the ring element is furthermore provided with a paving-stone pattern milled surface on the clamping side, which increases the friction. This milled surface increases the adhesive friction between the fixed part and the ring element, so that the latter cannot also turn when the tightening nut is turned.

Furthermore, both the conductive element and the tightening nut can be provided with a contact protection, where the ring element can be turned within the contact protection of the tightening nut. Such contact protection prevents unintentional touching of a pole terminal which has voltage applied to it during the tightening and loosening process, but does not hinder the rotation of the ring element.

It is advantageous if the contact protection of the conductive element is structured as a plastic housing, the wall of which is structured to be thicker in the area of the cross-bore. This thicker part reliably prevents unintentional touching of the conductive element or the ring element. Here, the thicker part is so large that a small finger surface which touches, particularly that of a child's finger, cannot come into contact with the conductive parts of the pole terminal.

An alternate embodiment of the invention provides that the tightening nut is structured as a cover sleeve which can be screwed onto the plug element of a cinch (RCA) plug, and that the pressure piece is structured as a ring element mounted on the front end of the cover sleeve, which exerts, with its inside part, axially and radially directed clamping forces on an outer ring contact of the cinch (RCA) plug, which is conical on the outside and provided with axial longitudinal slits. Such a cinch (RCA) plug with a clamping device according to the invention is particularly easy to use. Furthermore, here again the axially fixed part, namely the radially compressible outer ring contact, is damaged less, because a relative motion between the ring element and the outside of the outer ring contact, directed in the circumference direction, is avoided.

In this embodiment of the invention, it is practical if a tube-shaped partial piece follows the ring element, which piece projects beyond the mounting site into the cover sleeve, and is provided with one or more slits running in the axial direction, approximately up to the mounting site. With this tube-shaped partial piece, the ring element is precisely guided on the cover sleeve. The slits on the tube-shaped partial piece running in the axial direction allow easy and simple assembly of the ring element in the corresponding holder opening of the cover sleeve.

Furthermore, it is practical if the cover sleeve and the ring element are provided on the outside with an insulating coating, particularly an insulating anodized layer. With this insulation, undesirable side effects, which can particularly occur with cinch (RCA) plugs arranged closely next to one another, are avoided.

Figure 2:
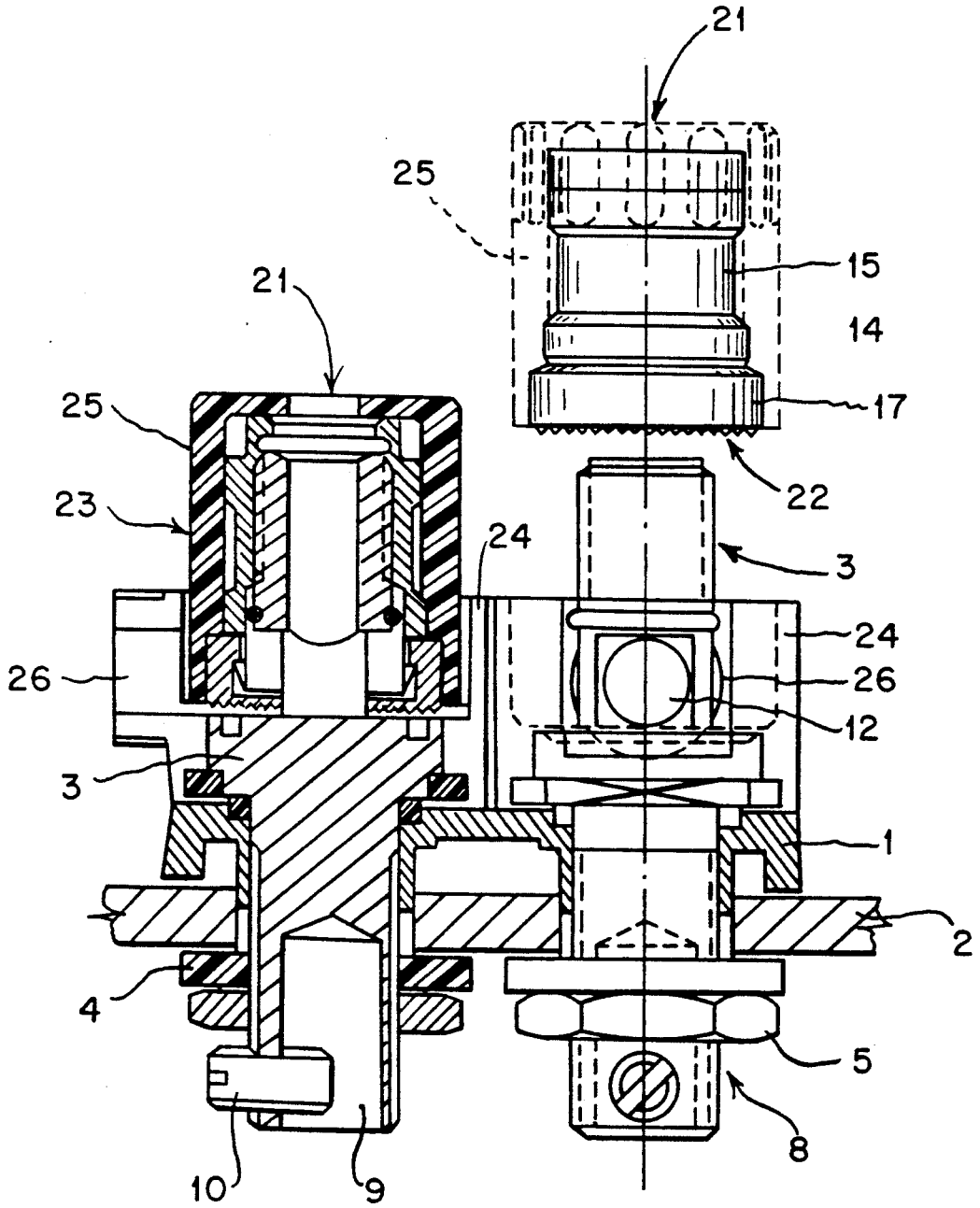
Figure 3:
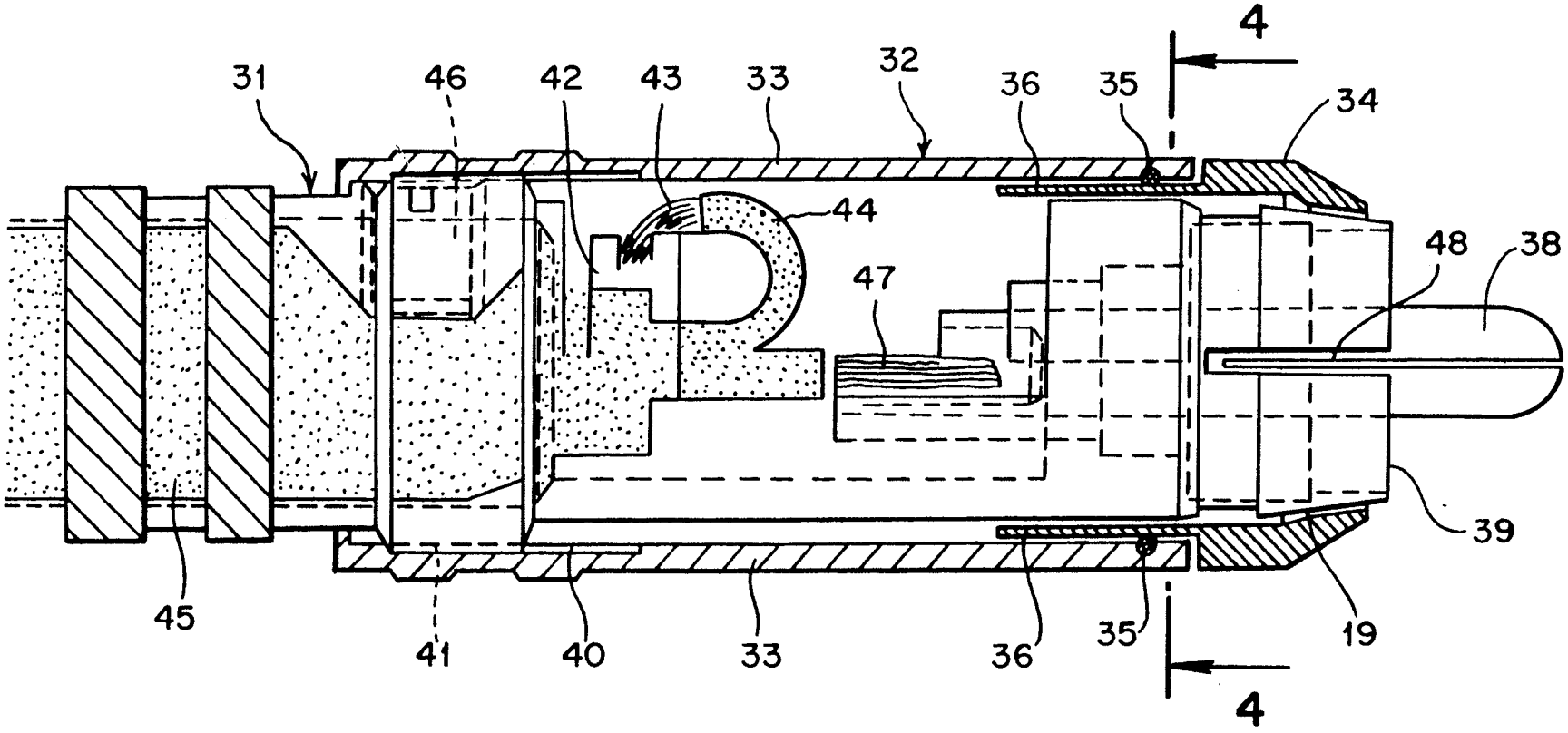
Figure 4:
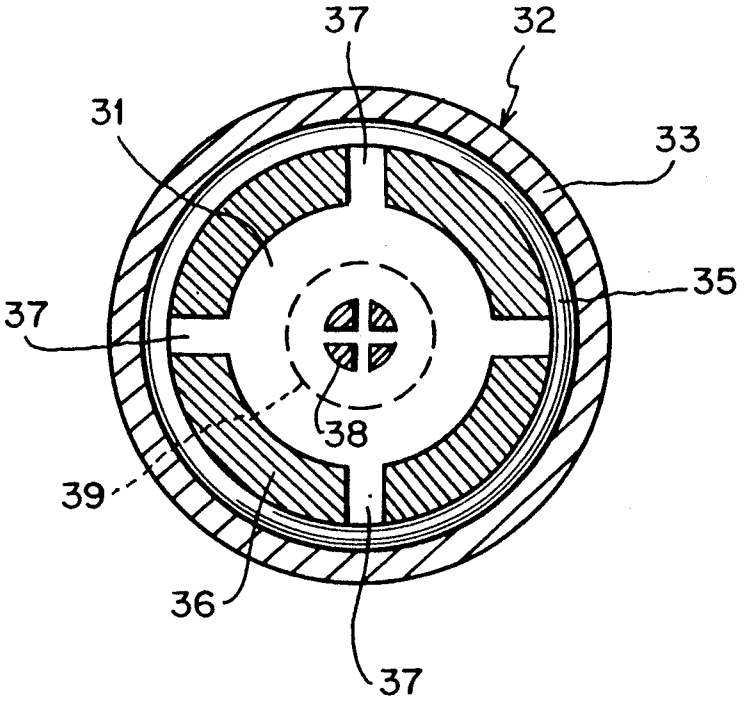

Embodiments of the invention are explained in greater detail below, on the basis of the drawings. The drawing shows:

FIG. 1 a clamping device according to the invention on a double-pole terminal in a first embodiment, in a side view in partial cross-section;

FIG. 2 a clamping device according to the invention on a double-pole terminal in a second embodiment with contact protection;

FIG. 3 a clamping device according to the invention on a cinch (RCA) plug with connected cable, in a side view and partially in longitudinal cross-section;

FIG. 4 a cross-section along line IV—IV in FIG. 3.

The double-pole terminal shown in FIG. 1 has an insulating element 1, which can be fixed in place on the housing 2 of a device in the category of entertainment electronics, for example. The individual pole terminals essentially consist of a metallic conductive element 3, which is braced relative to the insulating element 1 and the inside wall of the housing 2. In order to have an insulating attachment of the conductive element 3, there is a plastic lock washer 4 which rests against the inside wall of the housing 2, which is pressed on by means of a counter-nut 5. On the outside of the housing 2, the conductive element 3 is supported relative to the insulating element 1, which can be fixed in place, via a molded projection 6, which lies in an installed insulation 7.

The part of the conductive element 3 which projects into the housing 2 has a connector element 8 at its end, which is structured as a screw clamp connection. A line, not shown, can be attached to an axial bore 9 of the end of the conductive element 3 by means of a stud screw 10 which lies crosswise.

The part of the conductive element 3 which lies outside the housing 2 also has an axial bore 11, into which the tongue of a banana plug, not shown, can be inserted. Between the bore 11 and the projection 6, a cross-bore 12 which passes completely through is arranged through the conductive element 3, and an electric lead can be clamped into this bore.

A tightening nut 14 is mounted so as to rotate, via an axial thread 13 attached on the outside of the conductive element 3. The tightening nut 14 is comprised of a basic element 15 with an inside thread 16 and a ring element 17 arranged on the clamping side. The ring element 17, structured as a pressure piece, is mounted to rotate on the basic element 15, via a mounting site 18. The mounting is structured in such a way that a ring-shaped projection 19 on the ring element 17, facing inward, engages behind a ring shoulder 20 on the basic element 15. To hold a plug, the basic element 15 has a plug opening 21 on the frontal end.

To connect a lead to the pole terminal, the electric lead is introduced into the cross-bore 12, and the clamping screw 14 is screwed down on the thread 13. When the ring element 17 comes to rest against the electric lead located in the cross-bore 12, the ring element 17 no longer turns, but rather only presses against the lead. In order to increase the friction lock at the pressure point, the ring element 17, structured as a pressure piece, is provided with a paving-stone milled surface 22 on the clamping side.

The double-pole terminal shown in FIG. 2 corresponds to the structure of the double-pole terminal according to FIG. 1. The embodiment according to FIG. 2 has a contact protection 23, which shields both the conductive element 3 projecting out of the housing 2, and the tightening nut 14. The rotating ring element 17 can rotate within the contact protection 23, so that its function is not impaired by the contact protection 23. The surrounding contact protection 23 consists of a plastic housing 24 for the area of the cross-bore 12, and of a cap-shaped plastic housing 25 for the tightening nut 14. The walls of the plastic housings 24 and 25 are structured with greater thickness in the area of the passage openings 26 for the cross-bore 12 and in the area of the plug opening 21 to hold the plug. These thicker parts in the passage areas of the contact protection 23 are supposed to prevent small finger surfaces, especially those of children's fingers, from coming into contact with conductive parts of the pole terminal.

FIGS. 3 and 4 show the clamping device according to the invention using the embodiment of a cinch (RCA) plug. This has a plug element 31, onto which a cover sleeve 32 which acts as the tightening nut is screwed. This cover sleeve 32 is comprised of a basic sleeve 33 and a ring element 34, which serves as the pressure piece of the tightening nut. The ring element 34 is connected with the basic sleeve 33, so as to rotate, via a mounting site 35. The ring element 34 is followed by a tube-shaped partial piece 36, which projects beyond the mounting site 35 into the basic sleeve 33.

Approximately up to the mounting site 35, the tube-shaped partial piece 36 is provided with one or more axial slits 37, running in the axial direction, shown in FIG. 4. These slits 37 serve the purpose of being able to easily insert the ring element 34 into the basic sleeve 33 with its tube piece 36, for assembly. The tube-shaped partial piece 36 gives the ring element 34 secure and stable guidance in the basic sleeve 33 during tightening and loosening.

On the contact side, the plug element 31 is provided with a center contact pin 38 and an outer ring contact 39 which surrounds the pin in a ring shape. Towards the outside, the entire plug element 31 is covered by the cover sleeve 32, over its entire length. The basic sleeve 33 with the cover sleeve 32 is provided with a metallic inside thread 40 on the cable connection side, which is screwed onto a corresponding metallic outside thread 41 of the plug element 31. This metallic outside thread 41 forms an electrically conductive connection with the connector 43 for a shielding lead 44 of a coaxial cable 45, via a bridge 42. The coaxial cable 45 is held fixed in place in the plug element 31 by means of a clamping screw 46, which is shown with a dot-dash line in the drawing. Another connector 47 of the coaxial cable 45 is electrically connected to the center contact pin 38.

The outside ring contact 39 has one or more longitudinal slits 48 extending in the axial direction, so that the parts of the outer ring contact 39 formed in this way are resilient and can be pressed radially inward. The outside surface 49 of the outer ring contact 39 is structured conically and narrows towards the front, towards the contact side. The front end of the ring element 34 is structured to narrow towards the inside, in such a way that it rests against the conical outside surfaces 49 of the outer ring contact 39 from the outside. As is clearly evident from FIG. 3, the parts of the outer ring contact 39 formed by the longitudinal slits 48 are pressed radially inward due to the conicity of the outside surface 49, if the basic sleeve 33 is displaced axially in the direction towards the cable connector side, relative to the plug element 31. With this, the ring element 34 is correspondingly drawn towards the outside surface 49 of the outer ring contact 39, in the axial direction, without itself turning. The metallic cover sleeve 32, consisting of the basic sleeve 33 and the ring element 34, produces a metallic contact between the outer ring contact 39 and the connector 47 of the shielding lead 44 of the connected coaxial cable 45, and shields the entire interior space of the plug.

To plug the cinch (RCA) plug into a corresponding bushing, not shown in the drawing, the outer ring contact 39 is first pushed over the corresponding counterpart of the connector bushing, with the center contact pin 38 producing the intended electrical connection, at the same time. Then, by rotating the basic sleeve 33, the outer ring contact 39 is compressed radially by the ring element 34, which does not rotate, so that the outer ring contact 39 clamps tight against the corresponding counterpart of the connector bushing.

In the embodiment shown, the cover sleeve 32, which is comprised of the basic sleeve 33 and the ring element 34, can be coated on the outside with an insulating coating, for example an insulating anodized layer. This insulation prevents an electrical contact between the cover sleeves 32 of closely adjacent cinch (RCA) plugs.

I claim:

1. Clamping device having an axial direction for making an electrical connection comprising a tightening nut which can be screwed onto a screw thread of the clamping device, and, when adjusted in the axial direction, exerts a clamping force on a part which cannot be moved in the axial direction; said screw thread having an axis;

said tightening nut being provided on the clamping side with a separate pressure piece which transmits the clamping force, which is mounted on the tightening nut so as to rotate around the screw thread axis;

said clamping device is structured as a pole terminal, with a metallic conductive element, which is provided with the screw thread for the tightening nut and with a cross-bore to hold an electric lead;

said electric lead clamped in place in the cross-bore by the tightening nut, where the pressure piece is structured as a ring element which can be moved over an opening in the cross-section of the cross-bore; and a ring element having a ring-shaped projection facing inward, which engages behind a ring shoulder on the tightening nut.

2. Clamping device according to claim 1, wherein said ring element is provided with a paving-stone pattern milled surface on the clamping side, which increases the friction.

3. Clamping device according to claim 2, wherein both the conductive element and the tightening nut are provided with a contact protection, where said ring element can be turned within the contact protection of the tightening nut.

4. Clamping device according to claim 3, wherein the contact protection of the conductive element is structured as a plastic housing, the wall of which is structured to be thicker in the area of the passage opening for the cross-bore and the plug holder.

5. Clamping device having an axial direction for making an electrical connection, comprising a tightening nut which can be screwed onto a screw thread of the clamping device, and, when adjusted in the axial direction, exerts a clamping force on a part which cannot be moved in the axial direction; said screw thread having an axis;

said tightening nut being provided on the clamping side with a separate pressure piece which transmits the clamping force, which is mounted on the tightening nut so as to rotate around the screw thread axis; and said tightening nut is structured as a cover sleeve which can be screwed onto the plug element of a cinch (RCA) plug;

and the pressure piece is structured as a ring element mounted on the front end of the cover sleeve, which exerts, with its inside part, axially and radially directed clamping forces on an outer ring contact of the cinch (RCA) plug which is structured to be conical on the outside and radially deformable towards the inside.

6. Clamping device according to claim 5, wherein the cover sleeve has a mounting side and a tube-shaped partial piece follows the ring element, which piece projects beyond the mounting site into the cover sleeve, and is provided with one or more slits running in the axial direction, approximately up to the mounting site.

7. Clamping device according to claim 5, wherein the cover sleeve and the ring element are coated on the outside with an insulating coating anodized layer.

8. Clamping device having an axial direction for making an electrical connection comprising a tightening nut which can be screwed onto a screw thread of the clamping device, and, when adjusted in the axial direction, exerts a clamping force on a part which cannot be moved in the axial direction; said screw thread having an axis;

said tightening nut being provided on the clamping side with a separate pressure piece which transmits the clamping force, which is mounted on the tightening nut so as to rotate around the screw thread axis;

a conductive element provided with a plug holder which runs axially; and a ring element with a ringshaped projection facing inward, which engages behind a ring shoulder on the tightening nut.

9. Clamping device according to claim 8, wherein the ring element is provided with a paving-stone pattern milled surface on the clamping side, which increases the friction.

10. Clamping device according to claim 9, wherein both the conductive element and the tightening nut are provided with a contact protection, where said ring element can be turned within the contact protection of the tightening nut.

11. Clamping device according to claim 10, wherein the contact protection of the conductive element is structured as a plastic housing, the wall of which is structured to be thicker in the area of the passage opening for the cross-bore and the plug holder.

* * * * *